US006237268B1

(12) United States Patent
Levin

(10) Patent No.: US 6,237,268 B1
(45) Date of Patent: May 29, 2001

(54) SIGN STAND WITH SINGLE SPRING BASE ASSEMBLY

(75) Inventor: Yevgeniy M. Levin, Oak Park, MI (US)

(73) Assignee: Marketing Displays International, Farmington Hills, MI (US)

( * ) Notice: Subject to any disclaimer, the term of this patent is extended or adjusted under 35 U.S.C. 154(b) by 0 days.

(21) Appl. No.: 09/248,912

(22) Filed: Feb. 9, 1999

(51) Int. Cl.[7] ..... G09F 15/00

(52) U.S. Cl. ..... 40/606; 40/612; 248/160; 267/166; 267/179

(58) Field of Search ..... 40/606, 608, 610, 40/612; 248/160, 900; 267/176, 178, 179, 166

(56) References Cited

U.S. PATENT DOCUMENTS

| | | | | |
|---|---|---|---|---|
| 245,665 | * | 8/1881 | Scott | 267/178 X |
| 1,432,604 | * | 10/1922 | Lang | 267/178 X |
| 2,085,161 | * | 6/1937 | Kraus | 248/160 X |
| 2,160,676 | * | 5/1939 | Richard | 267/176 X |
| 2,254,566 | * | 9/1941 | Cornell, Jr. | 248/160 |
| 2,646,950 | * | 7/1953 | Nelson et al. | 267/178 X |
| 3,662,482 | * | 5/1972 | Sarkisian | 40/606 X |
| 4,033,536 | * | 7/1977 | Hillstrom | 40/608 X |
| 4,548,379 | | 10/1985 | Seely et al. . | |
| 4,569,499 | | 2/1986 | Seely . | |
| 5,442,871 | * | 8/1995 | Sarkisian et al. | 40/606 |
| 5,725,186 | | 3/1998 | Hillstrom et al. . | |
| 5,878,519 | * | 3/1999 | Huyck, Jr. et al. | 40/608 X |

* cited by examiner

*Primary Examiner*—Brian K. Green
(74) *Attorney, Agent, or Firm*—Harness, Dickey & Pierce, P.L.C.

(57) ABSTRACT

A sign stand having an improved resilient member to dissipate the torque-moment created by wind forces acting against a sign stand. The resilient member includes a coil spring, at least one plug having a helical protrusion and at least one mounting bracket. The plug is threaded into an end of the coil spring and the mounting bracket is fastened to the plug. A locking tab on the mounting bracket engages a flat ridge machined into at least one coil of the coil spring. This configuration eliminates relative rotation between the coil spring and the mounting bracket and as such, permits the effective transmission of torque into the coil spring while eliminating the potential for failure at the spring/bracket joint due to fatigue, fracture or mechanical loosening. The design of the resilient member also permits the servicing of each component as well as substantial weight reductions in the base of the sign stand.

21 Claims, 4 Drawing Sheets

SIGN STAND WITH SINGLE SPRING BASE ASSEMBLY

BACKGROUND OF THE INVENTION

1. Technical Field

The present invention relates generally to sign and sign stand devices and more particularly to an improved resilient member for coupling an upright member to a base.

2. Discussion

Numerous sign stand devices have been designed for displaying advertisements and information to the public. These signs are typically positioned on an upright member that is either anchored in the ground, held in place by sand bags or other heavy objects, or spring-mounted on bases which allow the upright member to bend or deflect relative to the base, without tipping over, under high wind forces. Several spring-mounted sign stands are shown in U.S. Pat. Nos. 4,548,379; 4,569,499; 5,725,186 and co-pending patent application entitled "Improved Sign Stand For Flexible Traffic Control Signage", Ser. No. 09/133,107, filed Aug. 12, 1998, the disclosures of which are hereby incorporated by reference as if fully set forth herein.

Some prior art sign stands have a single spring as the resilient member for coupling the upright member to the base. Such prior art sign stands are susceptible to damage from prolonged exposure to high winds. This damage typically results from a torque moment created by the force of the wind acting against the sign which would twist the upright member relative to the resilient member. In prior designs where the resilient member is coupled to the upright member and/or base by one or more threaded fasteners, the action of the wind against the sign can produce a moment that will work against these fasteners, causing them to loosen. The loosening of these fasteners causes a corresponding reduction in the clamping force exerted by these fasteners, thus allowing relative movement at the interface between the upright member and/or base and the resilient member. The relative movement between the resilient member and upright member and/or base can damage the fastener as well as the abutting surfaces. In some extreme cases, the upright member carrying the sign could literally unscrew from the base.

In view of this problem, several designs were developed which utilized dual springs, or in the case of a single spring, welded connections wherein the resilient member would either be welded directly to the upright member and/or base or to a structural member, such as a length of square tubing, which would receive the upright member or couple to the base. While the welded connection provided improved resistance to the torque moment produced by the wind, the welded connection was susceptible to fatigue and fracture due to the cyclic nature of wind forces. Additionally, the welded connection prevented the servicing of worn or damaged components, requiring instead the wholesale replacement of significant assemblies rather than just the damaged components.

With respect to the sign stand design which utilizes two springs, this design allows the moment produced by the wind forces to be absorbed by the two springs which are laterally offset from the axis of the upright member. While this design has significantly reduced the occurrence of damage to sign stands resulting from prolonged exposure to high winds, several drawbacks have been noted. These drawbacks include increased weight, increased size, additional fabrication labor and additional cost which are a byproduct of the duplication involved by including the second spring assembly.

Consequently, there remains a need in the art for an improved resilient member which is easily fabricated, relatively low in weight, compact in size and easily serviced.

SUMMARY OF THE INVENTION

It is therefore one object of the present invention to provide an improved resilient member for a sign stand which includes a single coil spring to dissipate the torque and tipping moment created by wind forces acting against the sign stand.

It is a more specific object of the present invention to provide a resilient member which includes at least one mounting bracket which is coupled to a coil spring in a manner which substantially limits or prevents relative rotation therebetween.

It is another object of the present invention to provide an improved resilient member which reduces the cost, weight, and overall size of a sign stand.

To achieve these objects, a sign stand is provided which utilizes the improved resilient member of the present invention to dissipate the torque and tipping moments created by wind forces acting against a sign stand. The resilient member includes a coil spring, at least one plug having a helical protrusion, and at least one mounting bracket. The plug is threaded into an end of the coil spring and the mounting bracket is fastened to the plug. A locking tab on the mounting bracket engages a flat ridge machined into at least one coil on the coil spring. This configuration eliminates relative rotation between the coil spring and the mounting bracket and as such, permits the effective transmission of torque into the coil spring while eliminating the potential for failure at the spring/bracket joint due to fatigue, fracture or mechanical loosening. The design of the resilient member also permits the servicing of each component as well as substantial weight reductions in the base of the sign stand.

Additional advantages and features of the present invention will become apparent from the subsequent description and the appended claims, taken in conjunction with the accompanying drawings.

DETAILED DESCRIPTION OF THE PREFERRED EMBODIMENT

Figure 1:
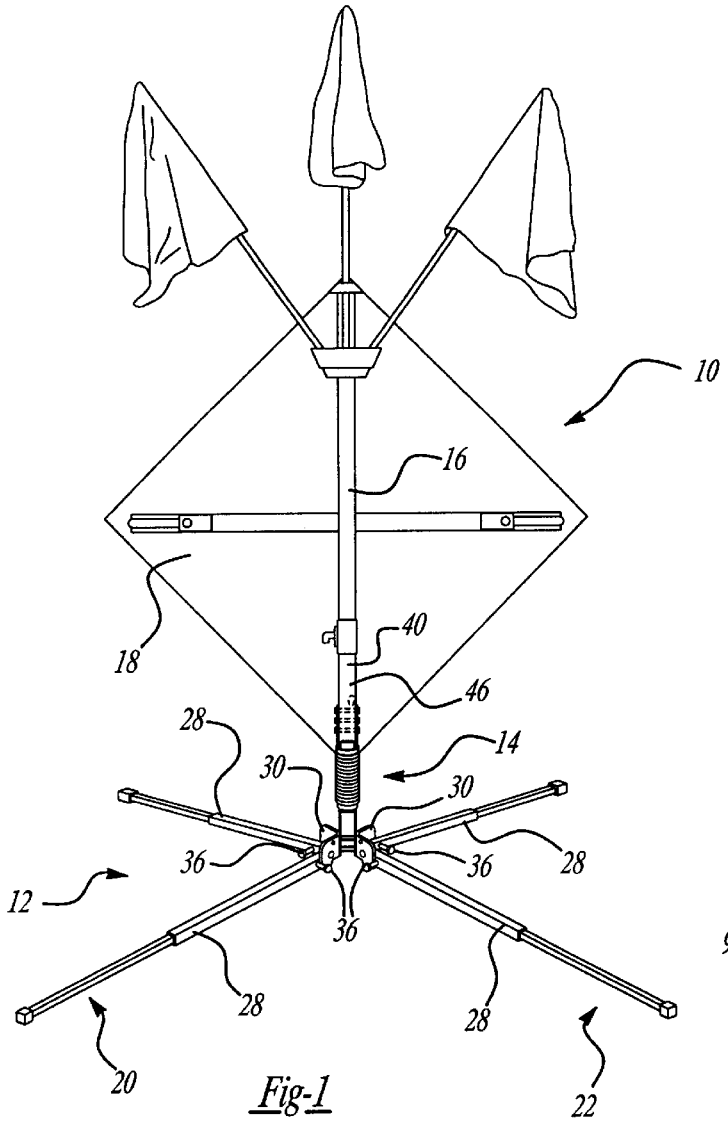
FIG. 1 is a perspective view of a portable sign stand having a resilient member according to a preferred embodiment of the present invention.
Figure 2:
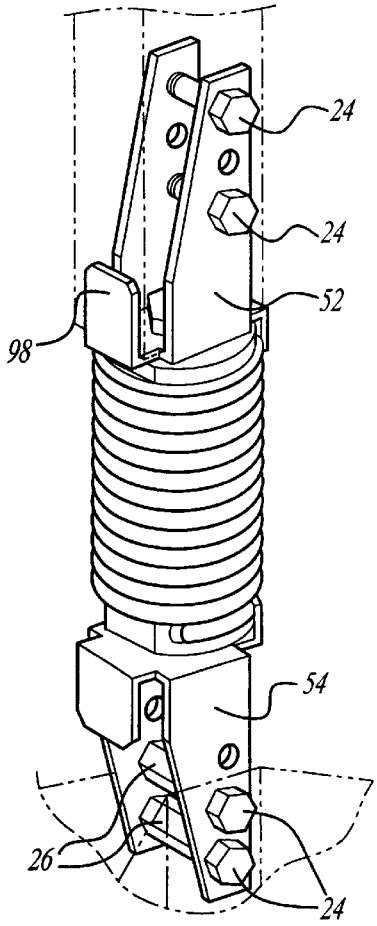
FIG. 2 an enlarged view of a portion of the resilient member shown in FIG. 1.

With reference to FIGS. 1 and 2 of the drawings, sign stand 10 is shown to include a base 12, a resilient member 14, an upright member 16 and a sign 18. Base 12 includes first and second base portions 20 and 22, respectively, a pair of fasteners 24 and a pair of spacers 26. As first and second base portions 20 and 22 are generally similar in construction, only first base portion 20 will be discussed in detail. First base portion 20 includes a pair of extensible leg assemblies 28 which are pivotably mounted to a base bracket 30. With additional reference to FIG. 3, base bracket 30 is shown to include a pair of retention apertures 32 and a series of positioning apertures 34 which are sized to receive a cylindrical, spring-loaded detent pin (not shown) from the detent pin mechanism 36 of each leg assembly 28. Engagement of a detent pin into a positioning aperture 34 prevents further rotational movement of the leg assembly 28 about its pivot point and thus maintains the leg assembly 28 in either a raised "storage" position or a lowered "deployed" position.

Figure 3:
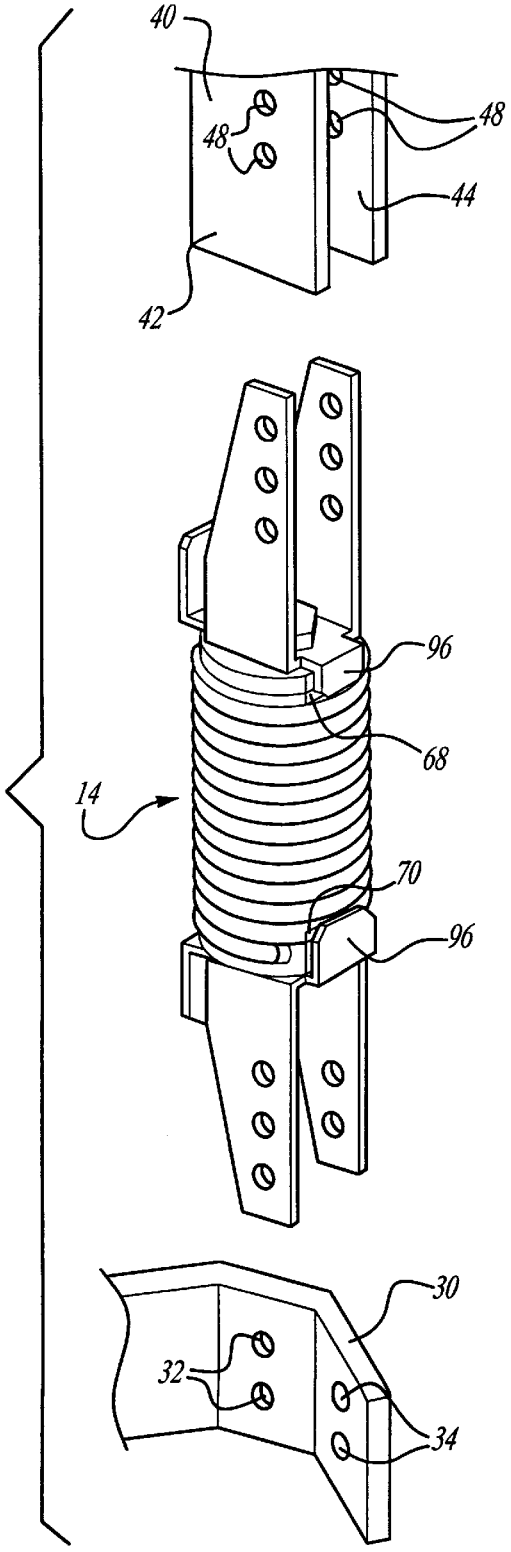
FIG. 3 is an exploded perspective view of a portion of the sign stand shown in FIG. 1.

With reference to FIGS. 1 and 3, upright member 16 is shown to include a vertical brace 38, a cam release 39 and a structural member 40. Vertical brace 38 and cam release 39 are disclosed in co-pending patent application entitled "Sign Stand With Cam Release", Ser. No. 09/247,774, filed Feb. 9, 1999 the disclosure of which is hereby incorporated by reference as if fully set forth herein. Structural member 40 is generally U-shaped and includes a pair of sidewalls 42 and 44 which are laterally spaced apart by end wall 46. Structural member 40 also includes a pair of retaining apertures 48 which extend through sidewalls 42 and 44.

Figure 4:
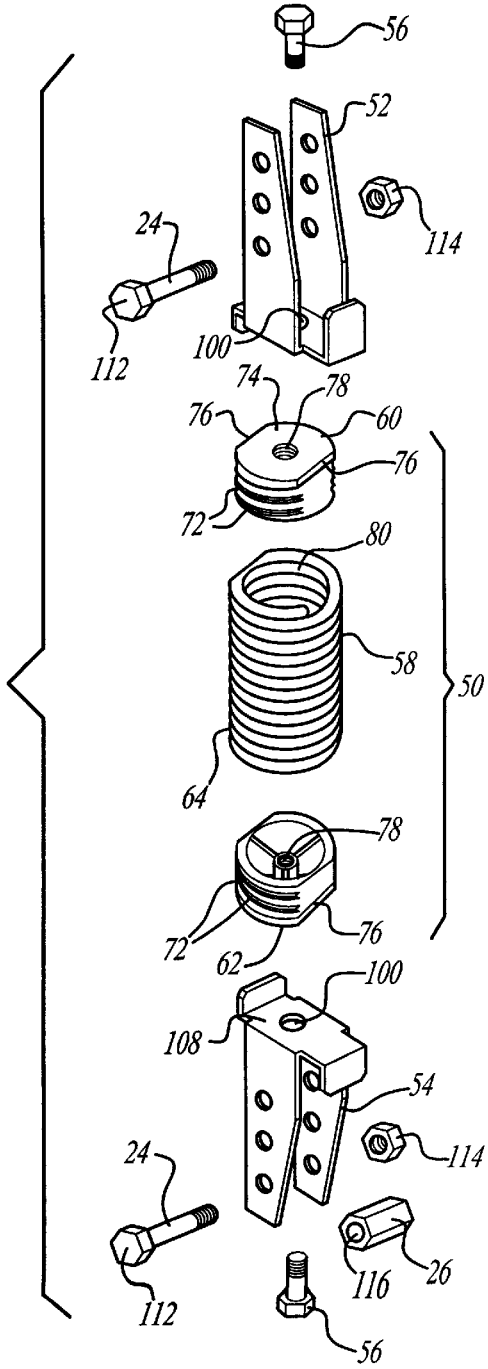
FIG. 4 is an exploded perspective view of a resilient member constructed in accordance with the preferred embodiment of the present invention.

Resilient member 14 is shown in FIG. 4 to include a spring assembly 50, a pair of mounting brackets 52 and 54 and fasteners 56. Spring assembly 50 includes a coil spring 58 and a pair of spring plugs 60 and 62. In the preferred embodiment, coil spring 58 is formed from 2/0 gage (0.331 inch diameter) oil tempered wire 64 and has a spring rate of approximately 250 lbf/inch. The initial tension of coil spring 58 is approximately 100 to 160 lbf and preferably between 117 and 143 lbf. However, the exact specifications of coil spring 58 will vary according to the specific requirements of a desired application.

Figure 5:
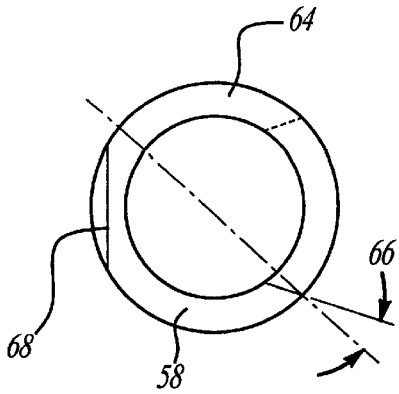
FIG. 5 is a top view of the coil spring of the preferred embodiment of the present invention.

With reference to FIG. 5, wire 64 terminates at each end of coil spring 58 at an angle designated by reference numeral 66 which is approximately 15 to 45 degrees from the centerline of coil spring 58, and preferably 25 degrees from the centerline. Configuration in this manner facilitates the subsequent installation of plugs 60 and 62 to coil spring 58. With additional reference to FIG. 3, coil spring 58 is shown to include a pair of flat ridges 68 and 70 which are formed into at least one coil at each end of coil spring 58. This feature will be explained in greater detail below.

Returning now to FIG. 4, plugs 60 and 62 are shown to include at least one helical thread-like protrusion 72, a substantially flat top surface 74, a pair of flats 76 and a threaded central aperture 78 which has been sized to threadably receive fastener 56. The helical thread-like protrusion 72 permits plugs 60 and 62 to threadably engage the interior section 80 of coil spring 58. Flats 76 are used during the fabrication or servicing of spring assembly 50 to apply torque to plugs 60 and 62 to facilitate their installation or removal. Typically, the distance across flats 76 is chosen to correspond with a standard wrench size (e.g., $1\frac{15}{16}$ inch) to permit the fabrication or servicing of spring assembly 50 without special tools.

Figure 6:
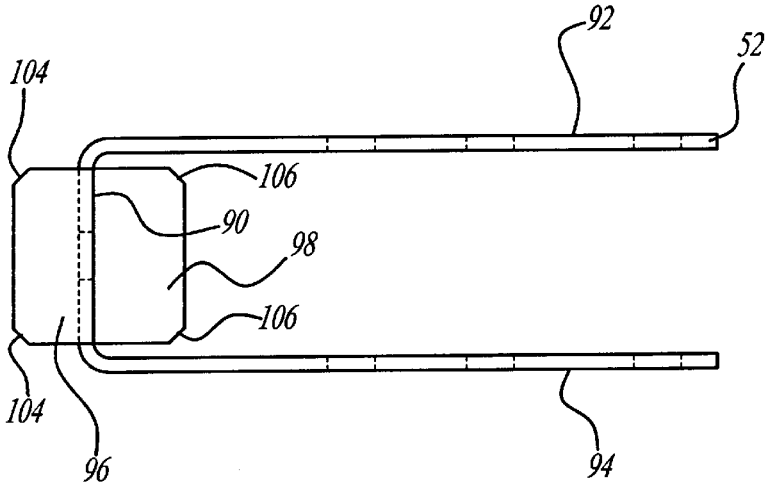
FIG. 6 is a front view of the mounting bracket of the preferred embodiment of the present invention.
Figure 7:
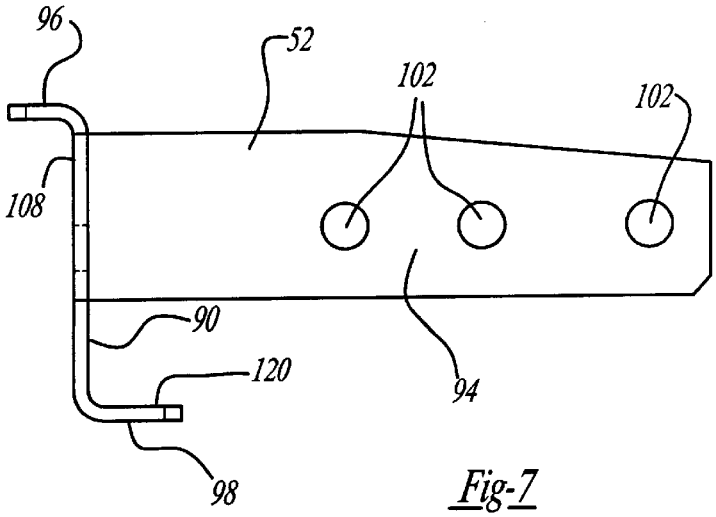
FIG. 7 is a side view of the mounting bracket of the preferred embodiment of the present invention.

Mounting brackets 52 and 54 are generally similar in construction and as such, only mounting bracket 52 will be discussed in detail. With reference to FIGS. 6 and 7, mounting bracket 52 is shown to include a base portion 90, first and second fork elements 92 and 94, a locking tab 96 and a support tab 98. Mounting bracket 52 is preferably fabricated from an 11 gage (0.120 inch) sheet steel in a progressive die, fourslide or similar type of equipment which permits it to be blanked and formed in a cost effective manner. With additional reference to FIG. 4, base portion 90 is shown to be substantially flat and include a central mounting aperture 100 which is sized to receive fastener 56. First and second fork portions 92 and 94 extend perpendicular to base portion 90 and each include at least one aperture 102 which permits mounting bracket 52 to be fastened to base 12 or upright member 16. Locking tab 96 is perpendicular in orientation to first and second fork portion 92 and 94 and depends away from base portion 90 in an opposite direction. Locking tab 96 includes a pair of chamfers 104 that eliminate sharp comers that could increase ear to resilient member 14. Support tab 98 is parallel to locking tab 96 but depends away from base portion 90 in the same direction as first and second fork members 92 and 94. Support tab 98 also includes a pair of chamfers 106 that eliminate sharp comers that could increase wear to sign stand 10.

Mounting bracket 52 is positioned at an end of spring assembly 50 such that locking tab 96 engages flat ridge 68 and the bottom side 108 of base portion 90 abuts flat surface 74 of corresponding plug 60. Fastener 56, which in shown to be a bolt, is then placed through aperture 100 and threaded into central threaded aperture 78. Fastener 56 is tightened to a level which produces a predetermined amount of clamping force sufficient to retain base portion 100 against flat surface 74 under a predetermined set of operating conditions to which sign stand 10 is expected to perform. Mounting bracket 54 is coupled to spring assembly 50 in a similar fashion and as such, will not be discussed in detail.

Resilient member 14 is positioned relative to first and second base portions 20 and 22 such that retention apertures 32 are aligned to apertures 102 in first and second fork members 92 and 94 of mounting bracket 54. Once so aligned, fasteners 24 and spacers 26 are used to fixedly, but removably, couple these components together. As shown, fastener 24 includes a bolt 112 and a nut 114. Spacer 26 is hexagonal in shape with a hollow center 116 which is sized to slidingly receive bolt 112.

Upright member 16 is positioned relative to mounting bracket 52 such that end wall 46 abuts the interior face 120 of support tab 98 and first and second fork members 92 and 94 straddle sidewalls 42 and 44, respectively. Support tab 98 is operable for positioning upright member 16 to align apertures 102 and retaining apertures 48. A pair of fasteners 24, each comprising bolt 112 and nut 114, extend through apertures 102 and retaining apertures 48 and rigidly couple upright member 16 to resilient member 14.

In operation, torque produced by wind forces acting against sign 18 is transmitted through upright member 16 into resilient member 14. The coupling of mounting brackets 52 and 54 to plugs 60 and 62, respectively, the engagement of support member 40 to support tab 98, and the engagement of locking tabs 96 with their respective flat ridge 68 or 70, facilitate the effective transmission of torque to coil spring 58 while significantly reducing, if not eliminating altogether, the risk of failure of the resilient member 14 due to fatigue or mechanical loosening.

Figure 8:
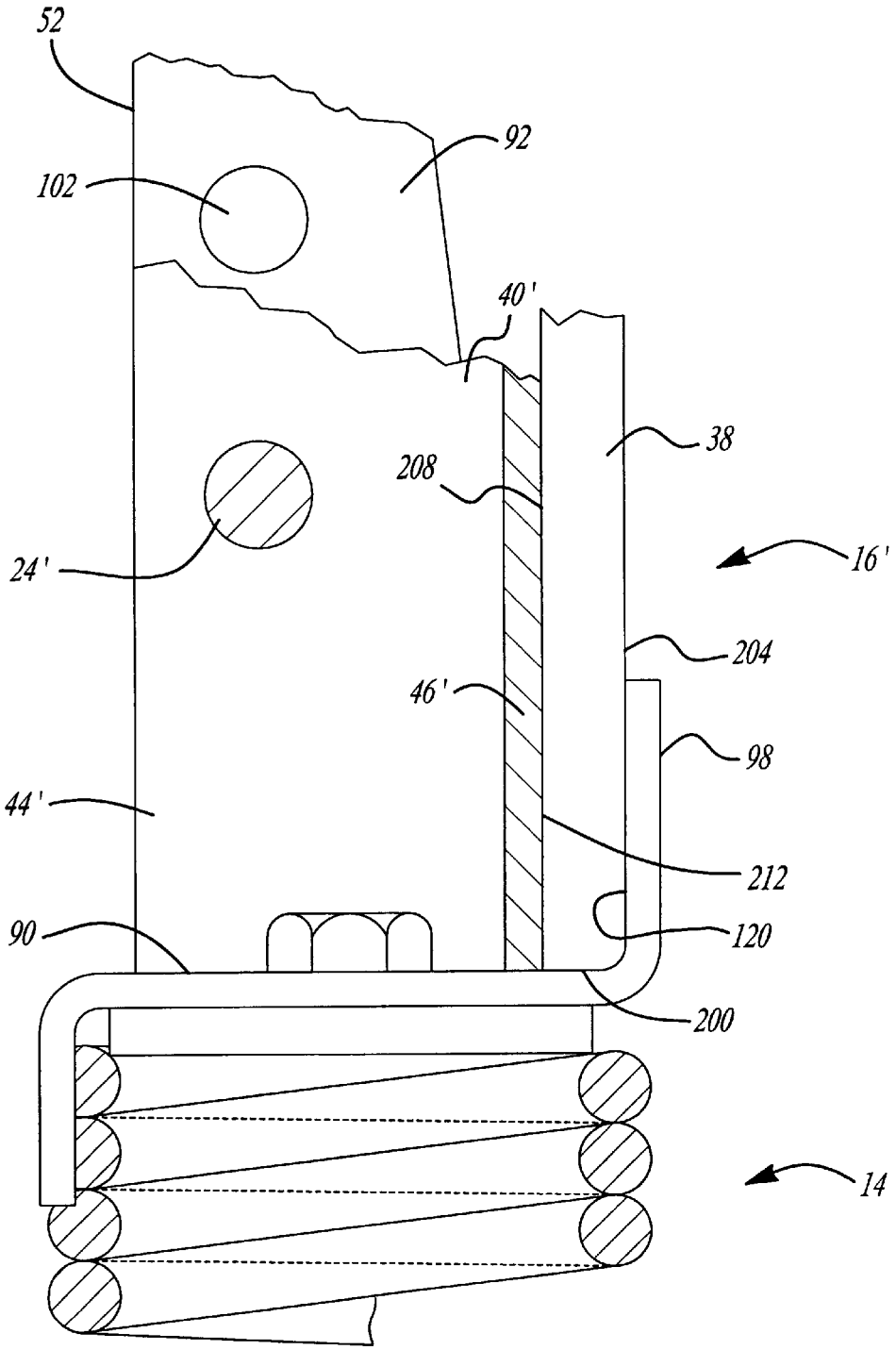
FIG. 8 is a partial section view of another portable sign stand having a resilient member according to a preferred embodiment of the present invention.

In an alternate embodiment, as shown in FIG. 8, upright member 16' is positioned relative to mounting bracket 52 such that end wall 46' is spaced apart from interior face 120. Structural member 40' is coupled to mounting bracket 52 such that first and second fork members 92 and 94 straddle sidewalls 42' and 44', respectively. Fasteners 24 secure structural member 40' to mounting bracket 52 in a manner similar to that discussed above. Vertical brace 38 extends downward from cam release 39 along endwall 46' into mounting bracket 52. The end 200 of vertical brace 38 abuts base portion 90 while the side surfaces 204 and 208 of vertical brace 38 abut interior surface 120 and the exterior surface 212 of end wall 46', respectively. As such, support tab 98 and cam release 39 combine to rigidly couple vertical brace 38 to structural member 40' and resilient member 14.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments following within the description of the appended claims.

What is claimed is:

1. A resilient member for a sign stand, said resilient member comprising:

a spring assembly having a coil spring defining a longitudinal axis and a first member coupled to said coil spring, said coil spring including a plurality of coils defining an outer surface and a flat ridge formed in at least one of said coils proximate a first end of said coil spring to provide a planar face on said outer surface, said planar face being generally parallel to said longitudinal axis; and a mounting bracket having a base portion coupled to a locking tab, said mounting bracket fixed to said first member such that said locking tab engages said planar face to prevent relative rotation between said mounting bracket and said spring assembly.

2. The resilient member for a sign stand of claim 1 wherein said locking tab extends perpendicularly away from said base portion in a first direction.

3. The resilient member for a sign stand of claim 2 wherein said mounting bracket is formed from sheet steel and includes first and second fork elements coupled to said base portion, said first and second fork elements extending perpendicularly away from said base portion in a second direction and said base portion spacing apart said first and second fork elements.

4. The resilient member for a sign stand of claim 3 wherein said mounting bracket further includes a support tab, said support tab coupled to said base portion and extending perpendicularly away therefrom in said second direction.

5. The resilient member for a sign stand of claim 1 wherein said first member includes at least one helical protrusion for threadably engaging said coil spring.

6. The resilient member for a sign stand of claim 5 wherein said first member is a plug which threadably engages an interior section of said coil spring.

7. The resilient member for a sign stand of claim 5 wherein an end of said coil spring terminates at an angle of 15 to 45 degrees relative to a line passing through a center of said coil spring.

8. The resilient member for a sign stand of claim 7 wherein said wire is terminated at an angle of approximately 25 degrees from said centerline.

9. A resilient member for a sign stand, said resilient member comprising:

a spring assembly having a coil spring with a plurality of coils, a flat ridge formed in at least one of said coils proximate a first end of said coil spring, and a plug with a central threaded aperture, a top surface and at least one helical protrusion, said plug inserted into said coil spring such that said at least one helical protrusion threadably engages an interior section of said coil spring;

a mounting bracket formed from sheet steel and including a base portion, a locking tab, first and second fork elements and a mounting aperture formed in said base portion, said locking tab coupled to said base portion and extending perpendicularly away therefrom in a first direction, said first and second fork elements coupled to said base portion and extending perpendicularly away therefrom in a second direction, said base portion spacing apart said first and second fork elements; and a threaded fastener inserted through said mounting aperture and threadably engaging said central threaded aperture of said plug.

10. The resilient member for a sign stand of claim 9 wherein said mounting bracket further includes a support tab, said support tab coupled to said base portion and extending perpendicularly away therefrom in said second direction.

11. A sign stand comprising:

a base;

an upright member;

a sign coupled to said upright member; and a resilient member coupled to said base and said upright member, said resilient member including:

a spring assembly having a coil spring and a first member coupled to said coil spring, said coil spring having a plurality of coils, a flat ridge formed in at least one of said coils proximate a first end of said coil spring; and a mounting bracket having a base portion coupled to a locking tab, said mounting bracket fixed to said first member such that said locking tab engages said flat ridge to thereby control relative rotation between said mounting bracket and said spring assembly;

wherein said mounting bracket is coupled to one of said base and upright member.

12. The sign stand of claim 11 wherein said locking tab extends perpendicularly away from said base portion in a first direction.

13. The sign stand of claim 12 wherein said mounting bracket is formed from sheet steel and includes first and second fork elements coupled to said base portion, said first and second fork elements extending perpendicularly away from said base portion in a second direction and said base portion spacing apart said first and second fork elements.

14. The sign stand of claim 13 wherein said mounting bracket further includes a support tab, said support tab coupled to said base portion and extending perpendicularly away therefrom in said second direction.

15. The sign stand of claim 13 wherein said base includes first and second base brackets, said mounting bracket coupled to said first and second base brackets such that said first base bracket abuts said first fork element and said second base bracket abuts said second fork element.

16. The sign stand of claim 11 wherein said first member includes at least protrusion for threadably engaging said coil spring.

17. The sign stand of claim 16 wherein said first member is a plug which threadably engages an interior section of said coil spring.

18. The sign stand of claim 16 wherein an end of said coil spring terminates at an angle of 15 to 45 degrees relative to a line passing through a center of said coil spring.

19. The sign stand of claim 18 wherein said wire is terminated at an angle of proximately 25 degrees from said centerline.

20. A sign stand comprising:

a base having first and second base brackets;

an upright member having a structural member having first and second sidewalls separated by an end wall;

a sign coupled to said upright member; and a resilient member having a spring assembly, a pair of mounting brackets and a pair of threaded fasteners, said spring assembly including a coil spring with a plurality of coils, a flat ridge formed in at least one of said coils proximate each end of said coil spring, and a pair of plugs, each plug having a central threaded aperture, a top surface and at least one helical protrusion, each of said plugs inserted into a different end of said coil spring such that said at least one helical protrusion threadably engages an interior section of said coil spring, said mounting brackets each including a base portion, a locking tab, first and second fork elements and a mounting aperture formed in said base portion, said locking tab coupled to said base portion and extending perpendicularly away therefrom in a first direction, said first and second fork elements coupled to said base portion and extending perpendicularly away therefrom in a second direction, said base portion spacing apart said first and second fork elements, and each one of said threaded fasteners coupling one of said pair of mounting brackets to one of said pair of plugs such that said threaded fastener extends through said mounting aperture and threadably engages said central threaded aperture;

wherein one of said pair of mounting brackets is coupled to said first and second base brackets such that said first base bracket abuts said first fork element and said second base bracket abuts said second fork elements, and said upright member is coupled to the other of said pair of mounting brackets such that said first and second fork elements abut said first and second sidewalls, respectively.

21. The sign stand of claim 20 wherein said mounting brackets further include a support tab, said support tab coupled to said base portion and extending perpendicularly away therefrom in said second direction.

* * * * *

UNITED STATES PATENT AND TRADEMARK OFFICE

CERTIFICATE OF CORRECTION

PATENT NO. : 6,237,268 B1
DATED : May 29, 2001
INVENTOR(S) : Yevgeniy M. Levin

It is certified that error appears in the above-identified patent and that said Letters Patent is hereby corrected as shown below:

Column 2,
Line 46, after "2" insert -- is --;

Column 4,
Line 15, "comers" should be "corners";
Line 16, "ear" should be -- wear --;
Line 20, "comers" should be "corners";

Column 6, claim 16,
Line 66, after "least" insert "one helical".

Signed and Sealed this

Eighteenth Day of December, 2001

*Attest:*

*Attesting Officer*

JAMES E. ROGAN
*Director of the United States Patent and Trademark Office*